United States Patent [19]

Hirata et al.

[11] Patent Number: 4,899,086

[45] Date of Patent: Feb. 6, 1990

[54] ELECTROLUMINESCENCE LIGHT EMISSION APPARATUS

[75] Inventors: Shinji Hirata; Katsumi Horinishi, both of Osaka, Japan

[73] Assignees: West Electric Company Ltd., Osaka; Canon, Inc., Tokyo, both of Japan

[21] Appl. No.: 138,487

[22] Filed: Dec. 28, 1987

[30] Foreign Application Priority Data

Dec. 29, 1986 [JP] Japan ..... 61-311074
Dec. 29, 1986 [JP] Japan ..... 61-311075
Dec. 29, 1986 [JP] Japan ..... 61-201315[U]

[51] Int. Cl.[4] ..... H05B 41/36
[52] U.S. Cl. ..... 315/169.3; 315/209 SC
[58] Field of Search ..... 315/169.4, 169.3, 169.1, 315/168, 230, 209 SC; 307/284

[56] References Cited

U.S. PATENT DOCUMENTS 3,611,022 10/1971 Galusha ..... 315/169.4

FOREIGN PATENT DOCUMENTS 52-45466 11/1977 Japan .
54-102923 8/1979 Japan .

*Primary Examiner*—Robert L. Griffin
*Assistant Examiner*—T. Salindong
*Attorney, Agent, or Firm*—Pollock, VandeSande & Priddy

[57] ABSTRACT

An electroluminescence light emission apparatus based on a switch circuit formed of a switch element and a thyristor connected in series across a DC power source, and a control circuit for setting the thyristor and switch element in alternating conducting and non-conducting states, with an electroluminescence element being coupled between one terminal of the power source and the junction of the switch element and thyristor to be thereby alternately charged and discharged to produce emission of light.

16 Claims, 4 Drawing Sheets

ELECTROLUMINESCENCE LIGHT EMISSION APPARATUS

BACKGROUND OF THE INVENTION

The present invention relates to an electroluminescence light emission apparatus which utilizes an electroluminescence element (abbreviated in the following to EL element) functioning to emit light in response to applied voltage pulses.

Various types of electroluminescence light emission apparatus based on EL elements are known in the prior art, which utilize a drive circuit such as that disclosed in Japanese Patent Publication No. 52-45466. The general configuration of the drive circuit described in that disclosure is as shown in FIG. 1. First and second switch circuits 1 and 2 formed of series-connected transistor pairs Tr1, Tr2 and Tr3, Tr4 respectively, are each connected in parallel across the output voltage from a DC power source E. An EL element 3 is connected between the connecting points of transistors Tr1, Tr2 and transistors Tr3, Tr4. Numerals 4 and 5 denote respective drive circuits for applying voltage pulses at appropriate timings to the transistors pairs Tr2, Tr3 and Tr4, Tr1 respectively, to thereby control the timings of respective conduction intervals of the transistors Tr1 to Tr4. In this way the supply voltage from the power source E is supplied as successive pulses across the EL element 3, with these pulses being of successively alternating polarity. Light is thereby emitted by the EL element 3.

With this prior art apparatus of FIG. 1, AC pulse drive is applied across the terminals of the EL element 3, i.e. pulses of successively alternating polarity with the amplitude of each pulse being equal to the output voltage from the power source E. That is, each time the output signal from the drive circuit 4 sets the transistors Tr2 and Tr3 in the conducting state, the transistors Tr1 and Tr4 are at that time held in the non-conducting state by the output signal from drive circuit 5. Thus, current flows in a path from one terminal of the power source E through transistor Tr3, EL element 3, and transistor Tr2 to the other power source terminal, in the direction indicated by the arrow A. The terminal of the EL element 3 which is connected to the connecting point of transistors Tr3 and Tr4 is thereby set at a positive potential and the terminal which is connected to the connecting point of transistors Tr1 and Tr2 is set at a negative potential, so that the EL element 3 becomes charged to a voltage which is substantially equal to the voltage from power source E. Next, when the opposite condition is established by the drive circuits 4 and 5, i.e. the transistors Tr2 and Tr3 are in the non-conducting state and transistors Tr1, Tr4 in the conducting state, current flows through a circuit path extending from one terminal of the power source E through transistor Tr1, through the EL element 3 and through transistor Tr4, i.e. in the direction indicated by the arrow B. This direction of current flow results in discharging of the charge which had been built on the EL element 3. At the point in time at which this flow of discharging current begins, the voltage which is developed across the EL element 3 is equal to the sum of the voltage to which the element has been charged and the voltage of the power source E, i.e. is substantially equal to twice the power source voltage. This prior art circuit therefore is advantageous in that an EL element requiring a relatively high value of drive voltage can be driven by utilizing a relatively low power source voltage. However since pulses of successively alternating polarity are applied to the EL element, i.e. an AC pulse drive configuration is utilized, the apparatus is basically more complex and expensive to manufacture than an apparatus in which only pulses of a single polarity are applied across the EL element, i.e. in which DC pulse drive is utilized.

Furthermore, as can be readily understood from the above description, the transistors Tr1 and Tr3 are alternately subjected to a maximum voltage which is twice the power source voltage, so that these transistors must have a high value of withstanding voltage. It is only necessary for the transistors Tr2 and Tr4 to have a relatively low value of withstanding voltage. However since it is preferable that all four of these transistors have substantially identical switching characteristics, it will in practice be necessary for each of the transistors Tr1 to Tr4 to have similar withstanding voltage characteristics. Since transistors which have a high value of withstanding voltage will provide only a relatively low level of gain, it is necessary to apply high levels of base drive current to these transistors in order to attain satisfactory switching operation. Thus, it is a problem of such a prior art apparatus that the overall power consumption is relatively high.

Conversely, if it is attempted to reduce power consumption by applying low levels of drive current to these transistors, the switching characteristics will become poor, and deterioration of the brightness of light emitted by the EL element will result.

Another type of drive circuit, which differs from that described above in being a DC pulse drive circuit, is described in Japanese Patent Laid-open No. 54-102923, and is shown in FIG. 2. With this apparatus, the collector of a transistor Tr6 is connected to the base of a charging transistor Tr5, to control the operation of transistor Tr5 by ON/OFF switching of transistor Tr6, i.e. to control charging of a load capacitance Z through transistor Tr5. The circuit configuration can be summarized as follows. The transistors Tr5 and Tr6 are connected in series through a diode D, while the cathode of the diode D is connected to the base of transistor Tr5. A resistor R is connected from the emitter of Tr5 to the capacitive load Z, which can be an EL element. With this circuit, DC pulse drive is applied to the load Z, so that this circuit is preferable to that of FIG. 1 for the case in which a high value of power source voltage is readily available. Two transistors Tr5 and Tr6 are utilized, and the same considerations regarding withstanding voltage requirements which have been described for the transistor pairs Tr1, Tr4 and Tr3, Tr2 in the example of FIG. 1 are also applicable to transistors Tr5 and Tr6 in FIG. 2. Thus, the disadvantage of relatively high power consumption being required, due to the switching characteristics of these transistors, is also encountered with the circuit of FIG. 2.

SUMMARY OF THE INVENTION

It is an objective of the present invention to overcome the disadvantages of the prior art described above, by providing an electroluminescence light emission apparatus having a simple configuration and a low level of power consumption, while providing a satisfactory level of emitted light brightness. To achieve the above objectives, an electroluminescence light emission apparatus according to the present invention basically comprises a switch circuit formed of a switch element and a thyristor connected in series, with charging and discharging of the EL element (or vice-versa) being respectively executed by alternately establishing a condition in which the switch element is set in a conducting state and the thyristor in a non-conducting state, and a condition in which the switch element is set in the non-conducting state and the thyristor in a conducting state.

DESCRIPTION OF PREFERRED EMBODIMENTS

Figure 1:
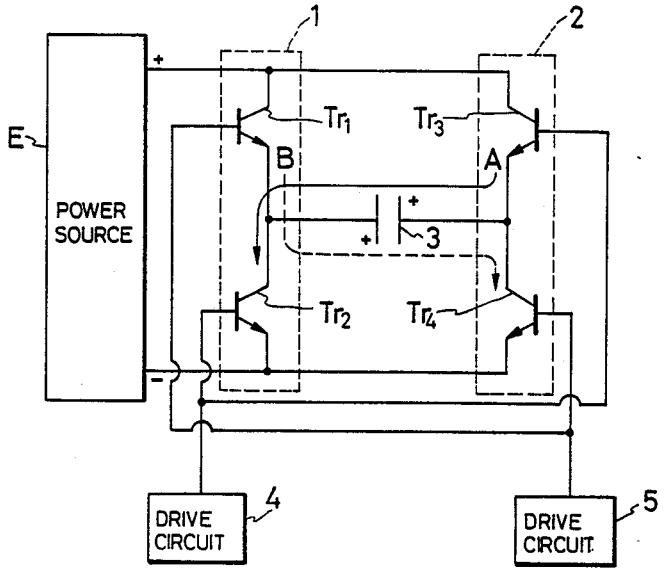
FIG. 1 PRIOR ART
FIG. 1 is a circuit diagram of a prior art example of an electroluminescence light emission apparatus, described in Japanese Patent Publication No. 52-45466.
Figure 3:
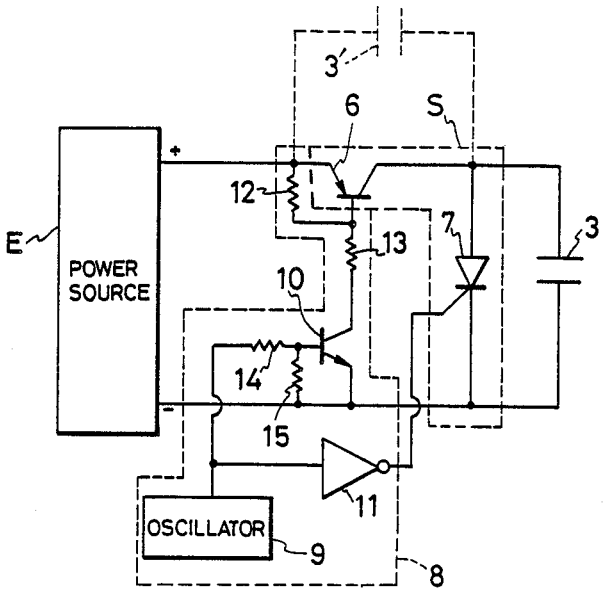
FIG. 3 is a circuit diagram of a first embodiment of an electroluminescence light emission apparatus according to the present invention.

FIG. 3 is a circuit diagram of a first embodiment of an electroluminescence light emission apparatus according to the present invention. Components in FIG. 3 which are functionally identical to components of the prior art example of FIG. 1 are designated by corresponding reference numerals or symbols. As will be clear from FIG. 3, a switch circuit formed of a series-connected combinations of a transistor 6 (functioning as a switch element) and a thyristor 7 (where the term "thyristor" as used herein signifies a three-electrode type of thyristor, often referred to as a silicon controlled rectifier or SCR) is connected between the negative and positive output voltage terminals of a power source E. An EL element 3 is connected between the anode and cathode of the thyristor 7. Numeral 8 denotes a control section, based on an oscillator 9, which produces switching pulses that are applied to the gate electrode of the thyristor 7 and to the base (i.e. control electrode) of the transistor 6. The control section 8 further includes a transistor 10 which functions as a switch element, an inverter 11, and resistors 12, 13, 14 and 15.

The operation of this embodiment is as follows. With a fixed supply voltage being produced from the terminals (designated as "+" and "−" respectively) of the power source E, when the output signal from the oscillator 9 of the control circuit 8 goes to a high potential level (i.e. a potential which is positive with respect to the "−" potential of the power source voltage, and is referred to in the following simply as the H level), a forward bias is thereby applied through resistors 14, 15 to the base of the transistor 10. At the same time, this H level output is inverted to a low potential level (i.e. which is identical to the "−" potential of the power source voltage, and is referred to in the following simply as the L level) by the inverter 11, which is applied to the gate electrode of the thyristor 7. The transistor 10 is thereby set in the conducting state, while the thyristor 7 is held in the non-conducting state. Due to the conducting state of the transistor 10, current flows from the power source E through resistors 12 and 13, whereby the transistor 6 is set in the conducting state. A charging current thereby flows from the power source E through the transistor 6 and the EL element 3, acting to charge the EL element 3. This charging current flow results in emission of light by the EL element 3, while charging the EL element 3 towards the power source voltage. After a sufficient time interval has elapsed to permit completion of this charging process, the output signal from the oscillator 9 goes to the L level, whereby the transistor 10 is set in the non-conducting state by an L level base bias, and an H level potential is applied to the gate electrode of the thyristor 7. The transistor 6 is thus also set in the non-conducting state, thereby disconnecting the power source E from the EL element 3, and the thyristor 7 set in the conducting state so that the charge which had accumulated on the EL element 3 is rapidly discharged through the thyristor 7. As this occurs, light is emitted from the EL element 3.

As discharging of the EL element 3 continues, the level of discharge current which thus flows through the thyristor 7 eventually falls below the holding current value of the thyristor, which then enters the non-conducting state in spite of the H level potential applied to the gate electrode. With the thyristor 7 now in the non-conducting state, the output signal from the oscillator 9 returns to the H level. The sequence of operations described above is thereafter successively repeated as the output signal from the oscillator 9 alternately switches between the H and L levels, with alternate charging of the EL element 3 and emission of light therefrom during each interval in which the transistor 6 is set in the conducting state, and discharging of the EL element 3 with light emission therefrom during each non-conducting interval of the transistor 6 when the thyristor 7 enters the conducting state. It can be understood that DC pulse drive is applied to the EL element 3 with this embodiment.

If the degree of discharging of the EL element 3 is insufficient, at a point when the transistor 6 is set in the conducting state by the output signal from the oscillator 9 changing from the L to the H level (i.e. if the level of discharge current flow does not fall below the holding current value of the thyristor 7 by that point in time) then there is a danger that both the transistor 6 and the thyristor 7 will then be in the conducting state simultaneously. Since these elements are connected in series across the output voltage from the power source E, such a condition could lead to destruction of one or both of the EL element 3 and thyristor 7. However in practice this problem can be easily avoided by ensuring that sufficient time is allowed for the discharge current flow from the EL element 3 to fall below the holding current value of the thyristor 7. That is to say, each of the L level intervals of the output signal from the oscillator 9 must have a duration which is greater than the maximum time required for the discharge current flow from the EL element 3 to fall below the thyristor holding current value, while the duration of each H level interval of the output signal from the oscillator 9 must be sufficient to ensure stability of light emission from the EL element 3.

The above problem can also be readily avoided by utilizing a gate turn-off type of thyristor for the thyristor 7.

With the embodiment of FIG. 3 as described above, energy is supplied to the EL element 3 through a switch element consisting of a transistor 6, while during each interval in which the transistor 6 is held in the non-conducting state to thereby disconnect the power source E from the EL element 3, a charge which has accumulated on the EL element 3 is discharged by current flow through the thyristor 7. It can be understood that this embodiment provides a very simple circuit configuration for implementing DC pulse drive of the EL element 3. In addition, no power is consumed from the power source E during each interval in which the EL element 3 is discharged, while in addition the thyristor 7 provides highly effective discharge operation.

In the embodiment of FIG. 3 described above, the EL element 3 is connected between the anode and cathode of the thyristor 7, so that the EL element 3 is charged by current flow through the transistor 6 and discharged by current flow through the thyristor 7. However it would be equally possible to connect the EL element 3 as indicated by the broken-line portion 3' in FIG. 3, between the collector and emitter of the transistor 6. In this case, the EL element 3 is charged by current flow through the thyristor 7 and discharged by current flow through the transistor 6. When the output signal from the oscillator 9 is at the L level, so that the transistor 6 is set in the non-conducting state and the thyristor 7 in the conducting state, charging of the EL element 3 occurs. On completion of charging, the current flow through the thyristor 7 falls below the holding current value so that the thyristor is set in the non-conducting state. When the output signal from the oscillator 9 then goes to the H level, applying an L level potential to the gate electrode of the thyristor 7, the thyristor is prevented from entering the conducting state, while the transistor 6 is set in the conducting state. The accumulated charge on the EL element 3 is thereby discharged through the transistor 6. It can thus be understood that such a circuit can provide similar effects to those obtained when the EL element 3 is connected across the thyristor 7.

Figure 4:
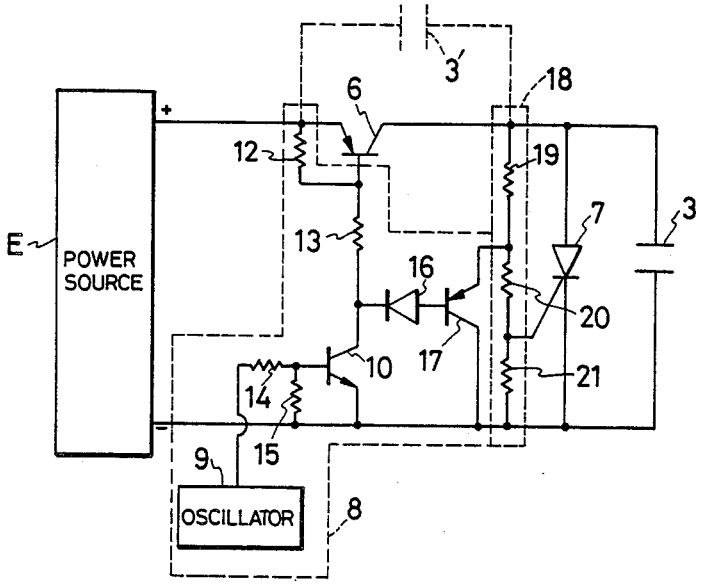
FIG. 4 is a circuit diagram of a second embodiment of an electroluminescence light emission apparatus according to the present invention.

FIG. 4 is a circuit diagram of a second embodiment of an electroluminescence light emission apparatus according to the present invention. Components in FIG. 4 which are functionally identical to components in the embodiment of FIG. 3 are indicated by corresponding reference numerals or symbols. As will be clear from FIG. 4, the control circuit 8 of this embodiment differs somewhat from that of the first embodiment of FIG. 3. Specifically the control circuit 8 includes a diode 16 and a transistor 17 as well as a gate bias section which is formed of three resistors 19, 20 and 21, in addition to the oscillator 9, transistor 10 and resistors 12, 13, 14 and 15. The resistors 19 to 21 are successively connected in series between the collector of transistor 6 and the emitter of the transistor 10, with the junction of resistors 20 and 21 being connected to the gate electrode of the thyristor 7 and with the resistors 20 and 21 being connected in series between the emitter and collector of the transistor 17. The diode 16 is connected between the base of the transistor 17 and the collector of the transistor 10.

The operation of this embodiment is as follows. When the output signal from the oscillator 9 goes to the H level, the transistor 10 is set in the conducting state whereby the transistor 6 is also set in the conducting state, thereby transferring the output voltage from the power source E to the collector of the transistor 6. A positive bias voltage is thereby applied to the emitter of the transistor 17, whereby base current from that transistor flows in the transistor 10, setting the transistor 17 in the conducting state. As a result, the gate electrode of the thyristor 7 is held at the L level, and is thereby maintained in the non-conducting state. The output voltage from the power source E is thereby applied across the EL element 3, so that charging of the EL element 3 begins and light is emitted thereby.

After an appropriate time interval, the output signal from the oscillator 9 returns to the L level, and the transistor 10 and transistor 6 are thereby each set in the non-conducting state. The collector of the transistor 6 is thereby disconnected from the power source E, so that the transistor 17 enters the non-conducting state and the short-circuit which had been thereby established across resistors 20, 21 is removed. The accumulated charge on the EL element 3 begins to discharge through the series-connected resistors 19, 20, 21 of the gate bias section 18, so that a positive bias is applied to the gate electrode of the thyristor 7, which enters the conducting state. The EL element 3 is thereby rapidly discharged by current flow through the thyristor 7, and light is thus emitted from the EL element 3.

When the level of discharge current flow through the thyristor 7 falls below the holding current value of the thyristor, then irrespective of the positive bias applied from the gate bias section 18, the thyristor 7 returns to the non-conducting state. Thereafter the output signal from the oscillator 9 returns to the H level, setting the transistor 10 in the conducting state, and charging of the EL element 3 again takes place. In this way successive charging and discharging of the EL element 3 takes place as the output signal from the oscillator 9 alternates between the H and L levels.

Thus with the embodiment of FIG. 4 as for the first embodiment of FIG. 3, charging of the EL element 3 occurs during each interval in which the transistor 6 is set in the conducting state, while discharging of the EL element 3 by current flow through the thyristor 7 occurs during each interval in which the transistor 6 is set in the non-conducting state to thereby disconnect the output voltage of power source E from the EL element 3.

The embodiment of FIG. 4 provides the advantage that the drive current which is applied to the gate electrode of the thyristor 7 each time that the thyristor is set in the conducting state is supplied as part of the discharge current from the EL element 3, rather than from the power source E as in the case of the embodiment of FIG. 3. Thus, the embodiment of FIG. 4 enables a reduction of overall power consumption to be attained.

With the embodiment of FIG. 4, as for that of FIG. 3, it would be equally possible to connect the EL element 3 at position 3' as indicated by the broken-line portion, between the collector and emitter of the transistor 6, so that charging of the EL element 3 takes place by current flow through the thyristor 7 and discharging occurs by current flow through the transistor 6, as described for the embodiment of FIG. 3. However the operation in that case differs from that in which the EL element 3 is connected across the thyristor 7, in that energy must be supplied from the power source E to the gate electrode of the thyristor 7 to set the thyristor in the conducting state.

With the embodiments of the present invention shown in FIGS. 3 and 4 described above a switch circuit, made up of a transistor functioning as a switch element and a thyristor connected in series, is coupled between the output terminals of a power source, and an EL element is connected either between the anode and cathode of the thyristor or between the collector and emitter of the transistor. By suitably controlling the timing at which the thyristor and the switch element are respectively set in the conducting state and non-conducting state, charging of the EL element through the switch element and discharging through the thyristor, or charging of the EL element through the thyristor and discharging through the switch element, can be executed. Both of these embodiments are advantageous with respect to efficient discharging of the EL element and the level of brightness of light emission from the EL element, while in addition due to the use of a thyristor, the overall circuit power consumption is low.

Figure 5:
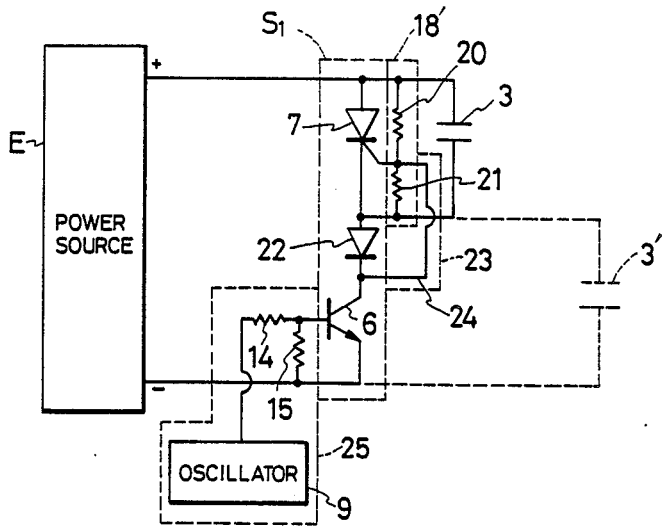
FIG. 5 is a circuit diagram of a third embodiment of an electroluminescence light emission apparatus according to the present invention.

FIG. 5 is a circuit diagram of a third embodiment of an electroluminescence light emission apparatus according to the present invention. Components in FIG. 5 which are functionally identical to components in the embodiment of FIG. 3 are indicated by corresponding reference numerals or symbols. With the embodiment of FIG. 5, as for the embodiments of FIGS. 3 and 4 described above, the configuration is based on a switch circuit S1 formed of a transistor 6 (functioning as a switch element), a diode 22 and a thyristor 7, connected in series. The embodiment of FIG. 5 has the objective of providing a more simple circuit arrangement, whereby the transistor 6 alone is utilized as a switch element, rather than for controlling another transistor used as a switch element. As in the previous embodiments, the switch circuit S1 is connected between the output terminals of the power source E. The anode of the thyristor 7 is connected to the positive terminal of the power source E, and the cathode connected to the anode of the diode 22, while the cathode of the diode 22 is connected to the gate electrode of the thyristor 7 through a connecting lead 24 constituting a reverse bias section 23. The operation of the transistor 6 is controlled by a control section 25 formed of an oscillator 9 and resistors 14 and 15 as shown. A gate bias section 18' is formed of resistors 20 and 21 connected in series between the anode and cathode of the thyristor 7, with the junction of these resistors connected to the gate electrode of the thyristor 7. The EL element 3 is connected between the anode and cathode of the thyristor 7.

The basic control of charging and discharging the EL element 3 by ON/OFF switching of the transistor 6 and thyristor 7 is essentially identical to that of the embodiments of FIGS. 3 and 4 described above. When the output signal from the oscillator 9 of the control circuit 25 goes to the H level, a forward bias is applied to the base of the transistor 6, setting that transistor in the conducting state. A charging current thereby flows from the power source E through the EL element 3, the diode 22 and transistor 6, resulting in emission of light from the EL element 3. A voltage drop is produced across the diode 22 due to this flow of current, and this voltage is applied as a reverse bias voltage to the gate electrode of the thyristor 7, through the connecting lead 24 of the reverse bias section 23. Due to this reverse bias, the thyristor 7 is held in the non-conducting state.

At the same time, a current flows through the resistors 20, 21 of the gate bias section 18'. However, the values of resistors 20 and 21 are selected such that a reverse bias voltage for the thyristor 7 is produced at the junction of resistors 20 and 21, in spite of the current flow into that junction through resistor 20. The thyristor 7 is thereby held in the non-conducting state at this time. After a suitable time has elapsed to permit charging of the EL element 3, the output signal from the oscillator 9 goes to the L level, and the transistor 6 is thereby set in the non-conducting state. Since a voltage drop no longer is developed across the diode 22, reverse bias is no longer applied to the gate electrode of the thyristor 7, and a discharge current flows from the EL element 3 through the resistors 20, 21 causing a forward bias to be applied to the gate electrode of the thyristor 7. The thyristor 7 thereby enters the conducting state, and the accumulated charge on the EL element 3 is rapidly discharged through the thyristor 7, while light is emitted by the EL element 3.

When the level of discharge current flow from the EL element 3 through the thyristor 7 falls below the holding current value, the thyristor 7 returns to the non-conducting state.

The above operations are successively repeated, with alternating charging and discharging of the EL element 3 by DC pulse drive operation, resulting in the desired emission of light.

If it is assumed that the output signal from the oscillator 9 charges from the L to the H level, to initiate charging of the EL element 3, at a time when a discharge current is still flowing through the thyristor 7, then the reverse bias which is developed across the diode 22 as described above will act to change the thyristor 7 from the conducting state to the non-conducting state. However in some cases this change of the thyristor from the conducting state to the non-conducting state may not take place so that there is a possibility of the thyristor 7 and transistor 6 both being in the conducting state simultaneously. However the duration of each interval of discharge current flow through the thyristor is substantially shorter than that of each interval in which EL element 3 is driven (by charging current passed through the transistor 6), the duration of the latter intervals being determined based upon requirements of stable light emission operation. This fact, together with the application of the reverse bias from the diode 22, ensures than in actual practice no problem will arise with regard to simultaneous conduction by both the thyristor 7 and transistor 6.

Again, the possibility of such a problem can be eliminated by employing a gate turn-off type of thyristor as the thyristor 7.

As in the case of the embodiments of FIGS. 3 and 4, it is of course possible to connect the EL element 3 in series with the thyristor 7 to be charged by current flow through the thyristor, i.e. to connect the EL element 3 at the position 3' of the broken-line circuit portion in FIG. 5, i.e. with the EL element 3 connected in parallel with the series-connected combination of diode 22 and transistor 6.

It can be understood from the above that with the embodiment of FIG. 5, the thyristor 7, diode 22 and a switch element consisting of the transistor 6 are connected in series to constitute a switch circuit S1. DC pulse drive of the EL element 3 is executed by ON/OFF switching of this switch circuit at predetermined time intervals. The thyristor 7 is controlled to be set in the conducting state and non-conducting state respectively, for charging and discharging the EL element 3, by a forward bias applied to the gate electrode from the gate bias section 18' and a reverse bias applied as the voltage drop across diode 22. The forward bias is developed as a result of a flow of discharge current from the EL element 3 during each interval of discharging the EL element, while the reverse bias is produced by a flow of charging current during each interval of charging the EL element.

Since the transistor 6 operates from the relatively low value of supply voltage produced from the power source E to control the operation of the thyristor 7, by means of the diode 22 etc., the control circuit 25 is simplified in structure, while the entire arrangement will be advantageous in connection with power consumption when compared to conventional arrangements. The embodiment of FIG. 5 has the advantage of a more simple configuration than those of FIGS. 3 and 4, and has a low level of power consumption.

Figure 6:
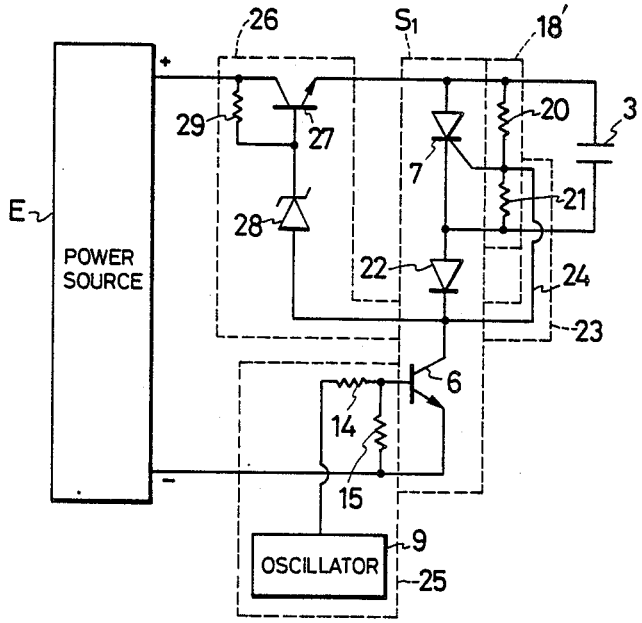
FIG. 6 is a circuit diagram of a fourth embodiment of an electroluminescence light emission apparatus according to the present invention.

FIG. 6 is a circuit diagram of a fourth embodiment of an electroluminescence light emission apparatus according to the present invention. Components in FIG. 6 which are functionally identical to components in the embodiment of FIG. 5 are indicated by corresponding reference numerals or symbols. This embodiment differs from that of FIG. 5 by further including a voltage stabilizer circuit 26 made up of a transistor 27, a zener diode 28 used as a voltage stabilizer element which is connected between the base of the transistor 27 and the collector of the transistor 6, and a resistor 29 which is connected between the base of transistor 27 and the positive output terminal of the power source E. The transistor 27 is connected between that power source E output terminal and the switch circuit S1.

The operation of this embodiment is similar to that of FIG. 5, other than with respect to the voltage stabilizer circuit 26. For brevity of description, only the operation pertaining to the voltage stabilizer circuit 26 will be described. When the output signal from the oscillator 9 goes to the H level, the transistor 6 is set in the conducting state, and as a result, current flows from the power source E through the resistor 29, zener diode 28, and back through the transistor 6, in a closed loop. The transistor 27 is thereby set in the conducting state, with a stabilized voltage being developed between the terminals of the zener diode 28 being produced at the emitter of the transistor 27. This stabilized voltage is applied to the series-connected combination of EL element 3 and diode 22 and to the series-connected combination of the resistors 20 and 21 and diode 22. As a result, a charging current flows into the EL element 3, passing through the diode 22, and light is thereby emitted. A voltage drop is thus produced across the diode 22, which is transferred through the reverse bias section 23 (i.e. the connecting lead 24) to the gate electrode of the thyristor 7, which is thereby held in the non-conducting state. As described for the embodiment of FIG. 5, the values of the resistors 20 and 21 are selected such that a sufficient value of reverse bias is applied to the thyristor 7 at this time.

After an appropriate time interval has elapsed, determined in accordance with the charging characteristic of the EL element 3, the output signal from the oscillator 9 falls to the L level whereby the transistor 6 is set in the non-conducting state and the power source E is thereby disconnected from the zener diode 28, while the transistor 27 enters the non-conducting state. Reverse bias is thus no longer applied from the diode 22 to the gate electrode of thyristor 7, and since a flow of discharge current through the resistors 20 and 21 occurs at this time, a forward bias is applied to the gate electode of the thyristor 7 which is thereby set in the conducting state. The accumulated charge on the EL element 3 is thereby rapidly discharged through the thyristor 7, with light being emitted from EL element 3.

The above operations are successively repeated, with alternating charging and discharging of the EL element 3 by voltage-stabilized DC pulse drive operation, resulting in the desired emission of light.

With the emodiment of FIG. 6, the supply voltage applied to the EL element 3 is effectively stabilized by the action of the voltage stabilizer section 26, thereby preventing variations in the level of brightness of the light emitted by the EL element 3 in the event of variations in the level of output voltage from the power source E.

As in the case of the the previously described embodiments, it is impossible with this embodiment to employ the thyristor 7 for charging the EL element 3 and the transistor 6 for discharging.

Figure 7:
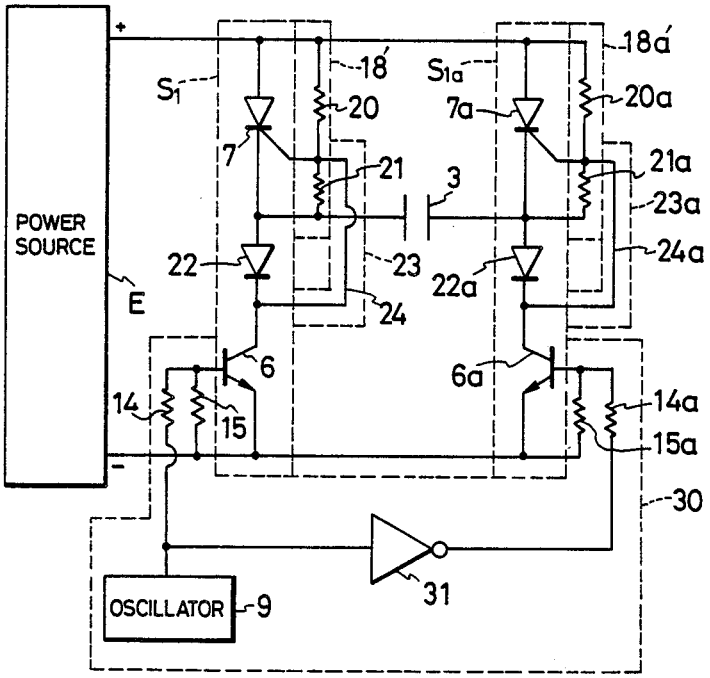
FIG. 7 is a circuit diagram of a fifth embodiment of an electroluminescence light emission apparatus according to the present invention.

FIG. 7 is a circuit diagram of a fifth embodiment of an electroluminescence light emission apparatus according to the present invention, based on switch circuits each composed of a switch element and a thyristor. In FIG. 7, components which are functionally identical to components in the embodiment of FIG. 5 are indicated by corresponding reference numerals or symbols. As will be clear from FIG. 7, this embodiment is based on the switch circuit S1 in the embodiment of FIG. 5. Basically, two such switch circuits, designated as S1 and S1*a* are utilized, each being of identical configuration to the switch circuit S1 of FIG. 5, and provided with respective gate bias sections 18' and 18*a*' and respective reverse bias sections 23 and 23*a*. The components of the gate bias section 18*a*' are designated as resistors 20*a* and 21*a*. The EL element 3 is connected between the junction of the anode of diode 22 and the cathode of the thyristor 7, and the junction of the anode of diode 22*a* and cathode of thyristor 7*a*. The transistors 6 and 6*a* are respectively driven by a control circuit 30 which includes an inverter 31 and resistors 14*a*, 15*a* for controlling the transistor 6*a*, in addition to the components described previously with reference to FIG. 5.

The operation of this embodiment is as follows. When the output signal from the oscillator 9 of the control circuit 30 goes to the H level, a forward bias is thereby applied from the junction of resistors 14 and 15 to the base of the transistor 6, which is thus set in the conducting state, while an L level output is applied from the output of inverter 31 to the base of the transistor 6*a* which is thereby held in the non-conducting state. Current thus flows from the power source E through resistor 20 of the gate bias section 18' and the transistor 6, while current also flows through the resistors 20*a*, 21*a* of the gate bias section 18*a*', then through the transistor 6. A reverse bias voltage is thereby developed across the diode 22, which is applied through the connecting lead 24' to the gate electrode of the thyristor 7, to hold the thyristor 7 in the non-conducting state. In addition, a forward bias is applied from the junction of resistors 20*a*, 21*a* to the gate electrode of thyristor 7*a*, to set this thyristor in the conducting state. As a result, a charging current flows through a path extending through the thyristor 7*a*, the EL element 3, the diode 22, and the transistor 6, whereby light is emitted by the EL element 3. Upon completion of charging of the EL element 3, the level of current flow through the thyristor 7a falls below the holding current value of that thyristor, so that thyristor 7a is returned to the non-conducting state. At this time a positive potential appears at the cathode of thyristor 7a and a negative potential at the cathode of the thyristor 7. After an appropriate time interval has elapsed for charging of the EL element 3, the output signal from the oscillator 9 returns to the L level, whereby the transistor 6 is set in the non-conducting state and the transistor 6a in the conducting state. In addition, a voltage drop developed across the diode 22a is applied through the connecting lead 24a to the gate electrode of thyristor 7a, which is thereby held in the non-conducting state. In this condition, thyristor 7 is set in the conducting state and a current flows through the thyristor 7, EL element 3, diode 22a and transistor 6a, in the reverse direction to that described above when transistor 6 is the conducting state. Light is thereby emitted from the EL element 3.

With the embodiment of FIG. 7 as described above, the EL element 3 is driven by a voltage whose amplitude is twice that of the power source E, i.e. AC pulse drive is applied to EL element 3 by the operation of the switch circuits S1 and S1a. Each of the thyristors 7 and 7a is held in the non-conducting state by a reverse bias which is applied when the corresponding one of transistors 6 and 6a in the corresponding one of the switch circuits S1, S1a is in the conducting state, with this reverse bias being developed across a corresponding one of the diodes 22, 22a. As a result, there is no possibility of both of the thyristors 7 and 7a being simultaneously in the conducting state.

Figure 2:
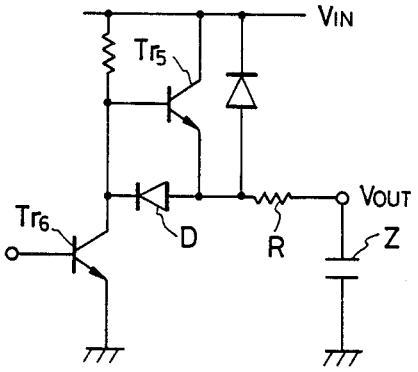
FIG. 2 PRIOR ART
FIG. 2 is a circuit diagram of a prior art drive circuit for a capacitive load, described in Japanese Patent Laid-open No. 54-102923.

As in the case of the previously described embodiments of the present invention, the embodiment of FIG. 7 has the advantage of providing a reduced level of power consumption by comparison with the prior art circuits of FIGS. 1 and 2.

What is claimed is:

1. An electroluminescence light emission apparatus powered by a DC supply voltage produced from first and second output terminals of a power source, comprising:

a series switch circuit comprising a thyristor and a switch element having a control electrode, said series swithc circuit being connected across said power source;

control means coupled to said control electrode and gate of said thyristor for alternately establishing a conducting state and a non-conducting state of said series switch element and said thyristor; and an electroluminescence element operatively coupled to said series switch element and thyristor and one of said power source terminals.

2. An electroluminescence light emission apparatus according to claim 1, in which said switch element is a transistor.

3. An electroluminescence light emission apparatus according to claim 1, in which said electroluminescence element is connected between an anode and a cathode of said thyristor, to be alternately charged by a current from said power source transferred through said switch element and discharged by a current flow through said thyristor.

4. An electraoluminescence light emission apparatus according to claim 1, in which said electroluminescence element is connected across said switch element, to be alternately charged by a current from said power source transferred through said thyristor and discharged by a current flow through said switch element.

5. An electroluminescence light emission apparatus according to claim 1, in which said control means is coupled to said thyristor gate electrode, and functions to apply a forward bias to said gate electrode to set said thyristor in the conducting state.

6. An electroluminescence light emission apparatus according to claim 1, further comprising gate bias circuit means coupled to said thyristor gate electrode and driven by a flow of current from said electroluminescence element to apply a forward bias to said gate electrode, for thereby setting said thyristor in the conducting state.

7. An electroluminescence light emission apparatus according to claim 6 in which said gate bias circuit means comprise a plurality of resistors connected in series across said electroluminescence element, with a junction between two of said resistors being coupled to said gate electrode of the thyristor.

8. An electroluminescence light emission apparatus according to claim 7, further comprising switch means coupled to said resistors of the bias circuit means, controlled by said control means for inhibiting a flow of current to said junction during said first operating condition.

9. An electroluminescence light emission apparatus powered by a DC supply voltage produced from first and second output terminals of a power source, comprising:

a switch circuit comprising a thyristor, a diode and a switch element having a control electrode, said thyristor, diode and switch element being successively connected in series between said first and second power source terminals with a cathode of said thyristor being connected to an anode of said diode;

control means coupled to said control electrode, for alternately establishing a first operating condition in which said switch element is held in a conducting state and a second operating condition in which said switch element is held in a non-conducting state;

an electroluminescence element coupled between one of said power source terminals and a connecting point of said thyristor and diode;

gate bias circuit means coupled to a gate electrode of said thyristor and driven by a flow of current produced through said electroluminescence element upon termination of said first operating condition for applying a forward bias to said gate electrode for setting said thyristor in a conducting state; and reverse bias circuit means for applying a voltage drop developed across said diode by a flow of current from said electroluminescence element through said diode during said first operating condition as a reverse bias to said gate electrode of said thyristor, for holding said thyristor in a non-conducting state.

10. An electroluminescence light emission apparatus according to claim 9, in which said electroluminescence element is connected between an anode and a cathode of said thyristor, to be alternately charged by a current from said power source transferred through said switch element and discharged by a current flow through said thyristor, and in which said current which drives said gate bias circuit means upon termination of the first operating condition is a discharge current from said electroluminescence element and said current passed through said diode during said first operating condition is a charging current of said electroluminescence element.

11. An electroluminescence light emission apparatus according to claim 9, in which said electroluminescence element is connected across a series circuit of said switch element and said diode, to be alternately charged by a current from said power source transferred through said thyristor and discharged by a current flow through said switch element, and in which said current which drives said gate bias circuit means upon termination of the first operating condition is a charging current from said electroluminescence element and said current passed through said diode during said first operating condition is a discharge current from said electroluminescence element.

12. An electroluminescence light emission apparatus according to claim 9, in which said gate bias circuit means comprises a pair of resistors connected in series between the anode and cathode of said thyrisor, with the junction of said resitors connected to said gate electrode of the thyristor, and in which said reverse bias circuit means comprises a connecting lead coupled between said gate electrode and the cathode of said diode.

13. An electroluminescence light emission apparatus according to claim 9, in which said switch element is a transistor.

14. An electroluminescence light emission apparatus according to claim 9 further comprising a transistor connected between one of said power source terminals and said switch circuit, and a voltage stabilizer element connected between a base terminal of said transistor and the cathode of said diode, for thereby applying a stabilized supply voltage to said switch circuit during said first operating condition.

15. An electroluminescence light emission apparatus powered by a DC supply voltage produced from first and second output terminals of a power source, comprising:

first and second switch circuits connected in parallel between said power source terminals, each of said switch circuits comprising a thyristor, a diode and a switch element having a control electrode, said thyristor, diode and switch element being successively connected in series, with a cathode of said thyristor connected to an anode of said diode;

control means coupled to the control electrodes of said switching elements of said first and second switch circuits, for setting said switching elements in a conducting state and a non-conducting state respectively in a mutually alternating manner; establishing a first operating condition in which said switch element is held in a conducting state and a second operating condition in which said switch element is held in a non-conducting state;

an electroluminescence element coupled between the point of connection of the thyristor and diode of said first switch circuit and the thyristor and diode of said second switch circuit;

first gate bias circuit means coupled to a gate electrode of the thyristor of said first switch circuit and driven by a flow of current produced through said electroluminescence element when the switch element of said second switch circuit is set in the conducting state, to set said thyristor of the first switch circuit in the conducting state, and second gate bias circuit means coupled to a gate electrode of the thyristor of said second switch circuit and driven by a flow of current produced through said electroluminescence element when the switch element of said first switch circuit is set in the conducting state, to set said thyristor of the second switch circuit in the conducting state; and, first reverse bias circuit means for applying a voltage drop developed across the diode of said first switch circuit while the switch element of said first switch circuit is in the conducting state, as a reverse bias to the gate electrode of the thyristor of said first switch circuit, and second reverse bias circuit means for applying a voltage drop developed across the diode of said second switch circuit while the switch element of said second switch circuit is in the conducting state, as a reverse bias to the gate electrode of the thyristor of said second switch circuit.

16. An electoluminescence light emission apparatus according to claim 15, in which each of said switching elements of said first and second switch circuits is a transistor.

* * * * *